US006346021B1

(12) United States Patent
Masse

(10) Patent No.: US 6,346,021 B1
(45) Date of Patent: Feb. 12, 2002

(54) SHORT MOTION SWIM FIN

(76) Inventor: E. Roger Masse, 340 Washington St., Tappan, NY (US) 10983

( * ) Notice: Subject to any disclaimer, the term of this patent is extended or adjusted under 35 U.S.C. 154(b) by 0 days.

(21) Appl. No.: 09/682,383

(22) Filed: Aug. 27, 2001

Related U.S. Application Data

(63) Continuation-in-part of application No. 09/606,361, filed on Jun. 29, 2000, now Pat. No. 6,280,272, which is a continuation-in-part of application No. 09/354,437, filed on Jul. 16, 1999, now Pat. No. 6,123,594.

(51) Int. Cl.[7] ..... A63B 31/08

(52) U.S. Cl. ..... 441/64

(58) Field of Search ..... 441/61–64; D21/806

(56) References Cited

U.S. PATENT DOCUMENTS 2,588,363 A * 3/1952 Corlieu ..... 441/64

* cited by examiner

*Primary Examiner*—Ed Swinehart
(74) *Attorney, Agent, or Firm*—Richard A. Joel, Esq.

(57) ABSTRACT

A short tapered fin, that when worn on the forward portion of the foot, acts as a lever to the foot with the fulcrum of that lever being on the underside of the foot. The effect of this lever action stretches the arch of the foot on every downward kick. The rigidity of the fin is also adjustable to the particular swimmer by varying the taper of the fin. The short tapered swim fin functions as a stretching device to stretch and increase the arch of the foot, and as a training device to strengthen the leg muscles that are used with the motions of flutter kick. This invention is a training swim fin that when used over time will improve a swimmer's performance for competitive swimming without fins.

7 Claims, 4 Drawing Sheets

SHORT MOTION SWIM FIN

CROSS REFERENCE TO RELATED APPLICATIONS

This application is a continuation in part of application Ser. No. 09/606,361, filed Jun. 29, 2000 now U.S. Pat. No. 6,280,272 which is a continuation in part of application Ser. No. 09/354,437 filed Jul. 16, 1999, now U.S. Pat. No. 6,123,594 issued Sep. 26, 2000.

BACKGROUND OF INVENTION

This invention comprises a short motion swim fin that functions as a stretching device to stretch and increase the arch of the foot, and as a training device to strengthen the leg muscles that are used with the motions of flutter kick. This invention differs in design, function, and mechanics from the prior art relating to swim fins, wherein it is an improved training device for the competitive swimmer; and not designed or intended as a more efficient propulsion device. This invention is a training swim fin that when used over time will improve a swimmer's performance for competitive swimming without fins.

This invention is intended and designed specifically for use with the flutter kick, which is a short, fast motion kick, used for the front or back crawl whereby the body is parallel to the surface of the water with the legs moving up and down from the hips, in short, fast motions, knees slightly bending, and the feet kept loose. The extent of flexible arching of the feet is the critical element for converting the leg motion into propulsion by presenting an angle of attack from the loosely arching foot on every downward kick. The downward kick is the power portion of the flutter kick, whereas the upward motion is more for balance and recovery. In the back crawl, the downward kick and upward motion reverse functions. The loosely arching function acts, if you will, as a propeller blade. In fact, many swimmers have a flutter kick that defines a spiral wake as a result of a well-defined arch. Although applicant's invention produces an impressive increase in propulsion, it does so as a result of short, fast, kicking motions, and accordingly is not designed or intended to conserve energy.

Whereas the relevant art studied discloses swim fins that are, for the most part, designed to function for underwater diving, and as such function for the propulsion efficiency in order to conserve energy. They do so by using a common principle whereby the fin, in one form or another, is worn as a flexible extension of the foot so that the fin itself presents a greater surface, and angle of attack against the water. This principle is well suited where conservation of energy, or air supply, is the primary consideration; but these fins are larger and also require a slower, longer kicking motion, comparable to using a larger gear to transfer power to a smaller gear for speed. These larger fins are not practical for the short, fast kicking motions of the flutter kick, or more specifically, as a training device for competitive swimming without fins.

In addition to the originality in use of this invention, there is also uniqueness in the design and mechanics. Specifically, it is a short tapered fin, that when worn on the forward portion of the foot, acts as a lever to the foot with the fulcrum of that lever being on the underside of the foot. The effect of this lever action stretches the arch of the foot on every downward kick. The rigidity of the fin is also adjustable to the particular swimmer by varying the taper of the fin.

The vast majority of the prior art patents cannot be practically used, or is not disclosed to be used, in a similar way as applicant's invention, specifically, as a stretching and training fin for the competitive swimmer and in particular, for the short motions of the flutter kick used in competitive swimming except for applicant's U.S. Pat. No. 6,123,594 and pending application Ser. No. 09/606,361, filed Jun. 29, 2000. Generally the prior art does not employ the same mechanics, or make any similar claims of the mechanics for a swim fin with a tapered flexible body to lever the arch of the foot.

The following prior art have as a common objective to be used in a dynamic fashion for moving a swimmer through the water more efficiently. This is shown in U.S. Pat. Nos. 5,597,336; 5,552,748; 3,789,448; 2,556,894 which are generally considered relevant to the disclosure.

U.S. Pat. No. 5,597,336 to Evans, has an open instep, with planar heel, so as to accommodate a plurality of foot sizes and discloses simplification of a single, two part, molding process. It is designed as a propulsion enhancement device with an elongated, flexible blade that has stiffening ribs under the foot, along the longitudinal axis of the fin, and also features unique protuberances to further reduce drag upon the blade surface.

U.S. Pat. No. 5,552,748 to Cressi discloses a three-part swim fin that has all the parts joined along the bottom of the shoe, which is a full shoe attached to a forked, arcuate part that holds the elongated fin. This arrangement is primarily intended to reduce the costs of production as compared to that of molded rubber fins. A flipper for enhancing propulsion is provided, wherein the fin has an elongated, flexible, obtuse angle to the shoe, or bottom of the foot.

U.S. Pat. No. 3,789,448 to Mitchell discloses a swimming aid for hand and foot propulsion that works on foot propulsion by using the legs in a pedaling, or climbing motion, whereby its design cause a stronger push against the water on the backward motion that it does on the forward motion.

U.S. Pat. No. 2,556,894 to Axiotes, discloses a swimming device for hand and foot propulsion that works on foot propulsion by using the legs in a pedaling, or climbing motion, whereby the device is kept in a perpendicular attitude to the leg on the backward motion to push against the water, and straightened, or feathered, on the forward motion for less resistance.

Applicant's U.S. Pat. No. 6,123,594 is directed to the field of this invention but this application represents a distinct improvement thereover and is far more economical to produce with fewer parts and facilitates insertion of the foot and accommodates various shoe sizes. The remaining U.S. Patents are mentioned as being merely of interest: U.S. Pat. Nos. 5,683,279; 3,302,223, 1,674,807; 3,922,740. U.S. Pat. No. 5,583,729 to Raasch, et al, provides a multi-part diving fin designed for propulsion enhancement with a pivotal footplate that engages the blade, or fin portion, in a manner that allows for adjusting the tension of the elongated blade according to the swimmer's ability.

U.S. Pat. No. 3,302,233 to Ciccotelli, discloses a swim fin comprising a rigid, flat sole plate that hinges a U-shape element, holding a flexible web, as the fin portion. The swimming motion of the leg causes the frame to move up and down independently from the motion or position of the boot, in a manner that is tensioned cantilever, so arranged as to present a greater angle of attack to the water on the downward motion than on the upward motion. The swim fin is designed to enhance propulsion with minimal strain on the foot.

U.S. Pat. No. 1,674,801 to Schwalge, discloses a swimming appliance that is used with a pedaling or climbing motion whereby the pushing direction offers more resistance to the water than the pulling direction resulting in horizontal or vertical propulsion. This swimming appliance also features a reinforced sole that is suitable for limited walking out of the water.

U.S. Pat. No. 3,922,740 to Potter is a hand paddle and not applicable for wearing on the foot.

SUMMARY OF INVENTION

This invention relates to swim fins and particularly to short motion swim fins. The rigid U-shape frame of U.S. Pat. No. 6,123,594 is replaced by a flat plate of thin, flexible material such as spring steel or a fiberglass composite in the parent case Ser. No. 09/606,361, filed Jun. 29, 2000. In the aforementioned application, the width end that fits under the arch of the foot is still referred to as the base end in the pending application. The plate is kept flexible on the length; but made rigid on the width by fastening non-flexible ribs running along the width on the bottom side of the plate. These ribs, or stiffeners, are fabricated from aluminum or a rigid composite material. The ribs are fastened to the plate by rivets or by lamination in the configuration described so that the plate remains flexible along it's length, but made to be rigid along it's width. The plate with attached stiffeners, is enclosed by the inner rubber sleeve in the same manner as the U-frame design whereby it forms a double surfaced closure on one end, but on the other end has only one diagonal flap that is folded over the base portion of the plate and secured so that it provides a rubber cushion to the bottom of the foot against the hard base edge of the plate.

The present invention, however, comprises a single molded piece of composite rubber that has a tapered thickness and a tapered shape. An outer sleeve secures the foot in place on the fin and rear bindings are used to connect the fin to the rear of the foot. The fin has a narrowed inner width that results in sleeve looseness along the edge for easier foot insertion. The tapered thickness improves the performance of the fin by producing a faster flexing action at the sculling edge and increases the overall strength by a more even distribution of flexing stresses. The invention eliminates a number of parts used in the prior art designs and is considerably less expensive.

Because the rigid U-shaped frame of applicant's U.S. Pat. No. 6,123,594 does not bend or flex it acts as an efficient stretching device when used with the flutter kick. Only the flexibility of the rubber sleeves dampens the forces placed upon the foot and leg muscles. Because of the limited flexibility of the rubber sleeves, the stress on the arch of the foot and leg muscles is considerable and can cause muscle cramping, particularly with swimmer's who have very muscular legs and/or a limited range of ankle motion.

On the other hand, the flexibility of the tapered design in this invention places less stress on the foot and, in fact, the stress can be controlled by the thickness of the material and the degree of taper or by varying the hardness of the material. In effect, the tapered fin design allows for different stress levels according to the swimmer's choice and/or ability.

Accordingly, an object of this invention is to provide effective training swim fins for the competitive swimmer to use in swimming workouts to improve upon the propulsion efficiency of his or her flutter kick in competition, or when not using swim fins.

A more specific object of this invention is to provide substantially rigid, short motion, swim fins that are worn on the forward portion of the feet, so as to arch the entire foot including all joints distal to the ankle.

Another specific object of this invention is to provide swim fins of a calculated small size, with a tapered body and width that is flexible on the length but substantially rigid on the width to function as a lever to stretch the arch of the foot, so that the foot itself is included in the angle of attack. So in effect, the mechanics of the invention causes the foot to flex by the force of the water against the fin with every downward motion of the flutter kick.

A further object of this invention is to provide longitudinally flexible, short motion swim fins, that are small enough to allow a fast motion, but in a manner that requires the flexing motions of the entire foot, and as such also involves and strengthens those corresponding fast twitch leg muscles.

A still further object of this invention is to provide a pair of swim fins that are both the same and therefore interchangeable on either foot, and with one size to fit most foot sizes.

A still further object of this invention is to provide attachment components that with the tapered design make insertion of the foot of the swimmer relatively easy.

A more specific object of this invention is to provide an economical molded new and improved tapered swim fin with an interior narrowed width and which is tapered lengthwise and thickness wise.

BRIEF DESCRIPTION OF DRAWINGS

The above and other objects and advantages of this invention may be more clearly seen when viewed in conjunction with the accompanying drawings wherein.

DETAILED DESCRIPTION

Figure 1:
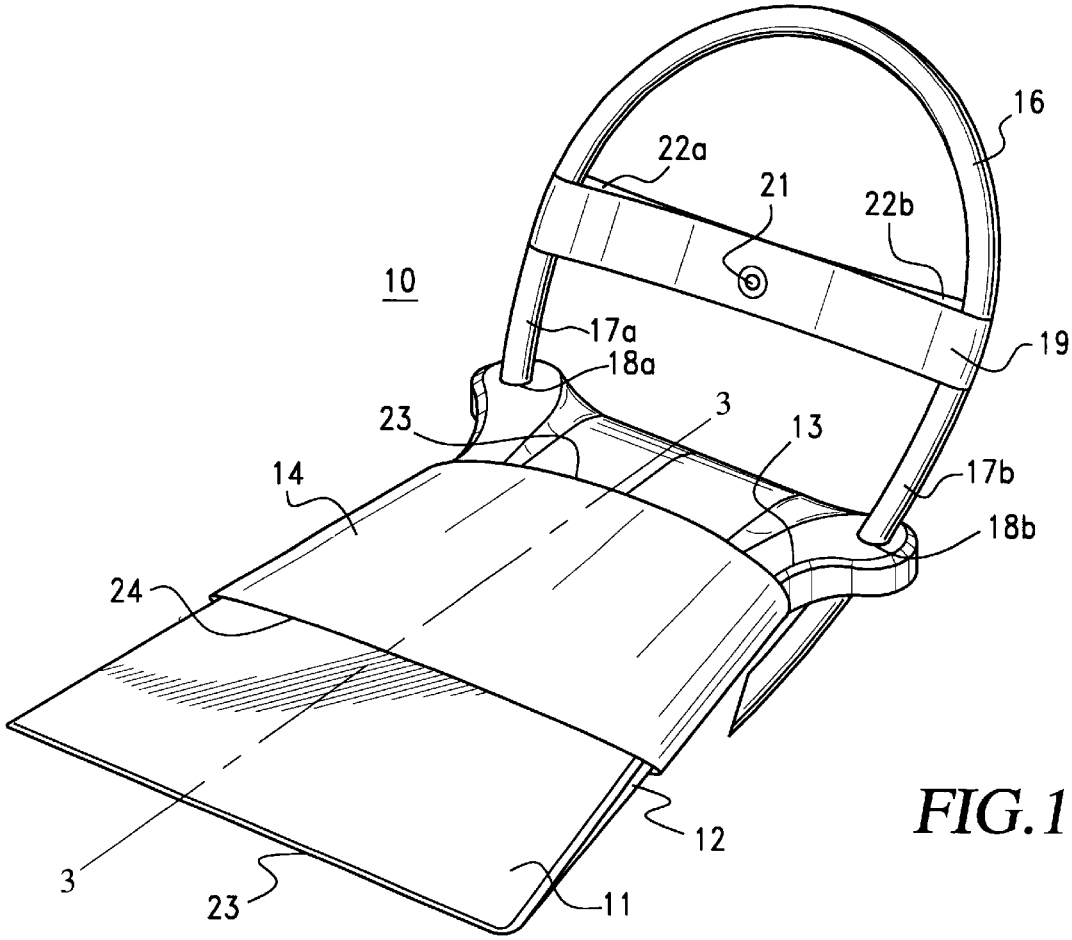
FIG. 1 is a perspective view of the assembled swim fin comprising the invention.

Referring now to FIG. 1 of the drawings, the invention comprise a short motion swim fin 10 comprising a fin portion 11 which is tapered along its thickness 12 and at 13 along its width. An outer sleeve 14 is positioned over the fin portion 11 to hold a foot in position. A rubber tubular strap 16 is inserted at its ends 17*a* and 17*b* through apertures 18*a* and 18*b* in the fin portion 11. A continuous open strap 19 is fastened at its center by connector 21 and includes openings 22*a* and 22*b* through which the tubing 16 is inserted.

Figure 2:
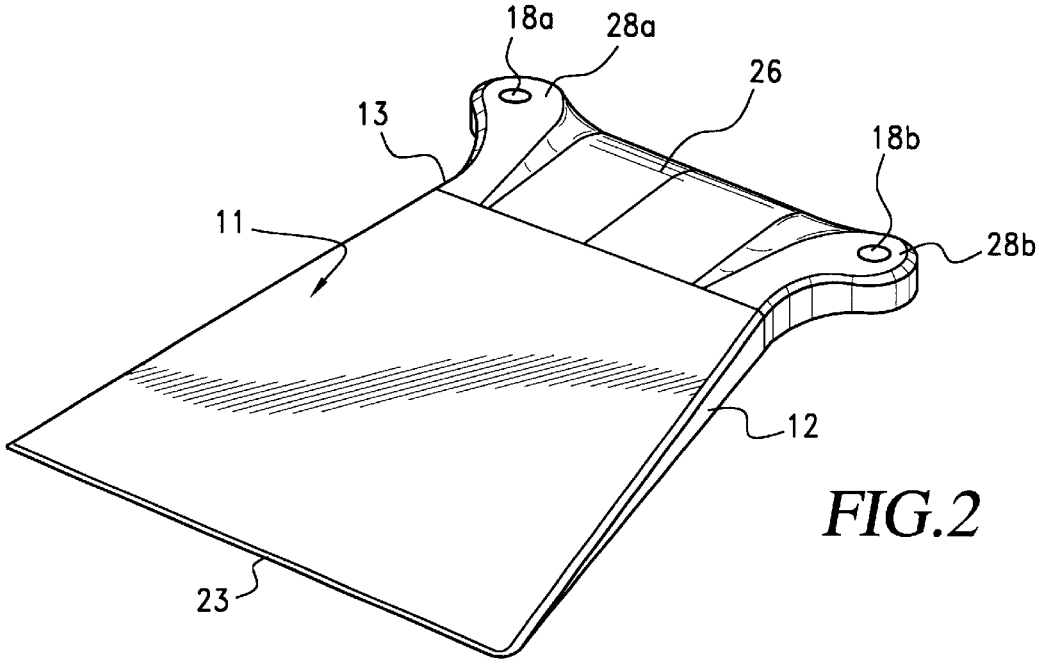
FIG. 2 is a perspective view of the fin portion of the short motion swim fin.

FIG. 2 shows the fin portion 11 with its tapered thickness 12. The fin body 11 is a cast molding (injection mold) producing a single piece of rubber composite material. The fin body 11 also has a tapered shape 13 when viewed from the top or bottom. The molded fin body effectively replaces the rectangular flat plate of thin flexible material produced by cutting from sheet material and also eliminates the need for adding width stiffeners as in the prior art. Here increasing the thickness 12 of the molded body 11 provides the required stiffness along the width. In addition, the tapered shape of the body 12 reduces the width 13. This one-piece design substantially reduces the cost of production.

The tapered thickness 12 of the invention also improves the performance of the fin 10 by producing faster flexing action at the sculling edge 23 and increases the overall strength of the piece 11 by a more even distribution of the flexing stress.

The invention also eliminates the first rubber sleeve that enveloped the flat, rectangular shaped plate, in a taut relationship, for the purpose of providing a cushion for the underside of the foot as well as a sculling edge in the prior art. Since the swim fin 10 is cast as a single piece of rubber based composite material, it provides sufficient softness to eliminate the need for a first flexible sleeve as a cushion and sculling edge. The elimination of the first or inner sleeve also reduces cost.

The prior art includes a flat, rectangular shaped plate enveloped by a first flexible sleeve, and both parts are enveloped by a second, outer flexible sleeve which is also held in a tact relationship to the rectangular plate. This uniform tightness of the outer sleeve makes it difficult to insert the foot in contrast to the present design.

The new swim fin 10 keeps the outer sleeve 19 as the only sleeve to hold the swimmer's foot 20. However, the fin body 11 with a tapered shape 13 (top or bottom view) now presents a narrowed width 13 to the sleeve edge 23 where the foot is inserted. This narrowed width 13 allows the sleeve 19 the looseness along that edge 23 for easier insertion of the foot (see FIG. 5).

When the foot 20 is inserted, the sleeve 19 is pushed forward against the taper 13 of the fin 11. This causes more stretching along the edge 24 of the sleeve 19 where the toes 25 protrude. The optimum tension is when the sleeve 19 is sufficiently stretched to resist the forward pressure from the foot 20 (see FIG. 5).

With the foot 20 in place and the proper holding adjustments made on the elastic loops 16, the flexing action of the fin 10 now causes the taper 13 to exert a backward or reverse pressure against the sleeve 14. This backward pressure from the cam action of the taper 13 maintains a constant, optimum sleeve tension around the foot 20. In other words, the tapered shape of the fin body 11, in motion, interacts with the sleeve 14 as a self-adjusting feature to different foot sizes.

FIG. 2 shows the fin body 11 is greater detail with a sloping rear portion 26 to accommodate the arch 27 of the foot 20. The apertures 18*a* and 18*b* are positioned in the rear thicker portion 28*a* and 28*b* of the fin body 11.

Figure 3:
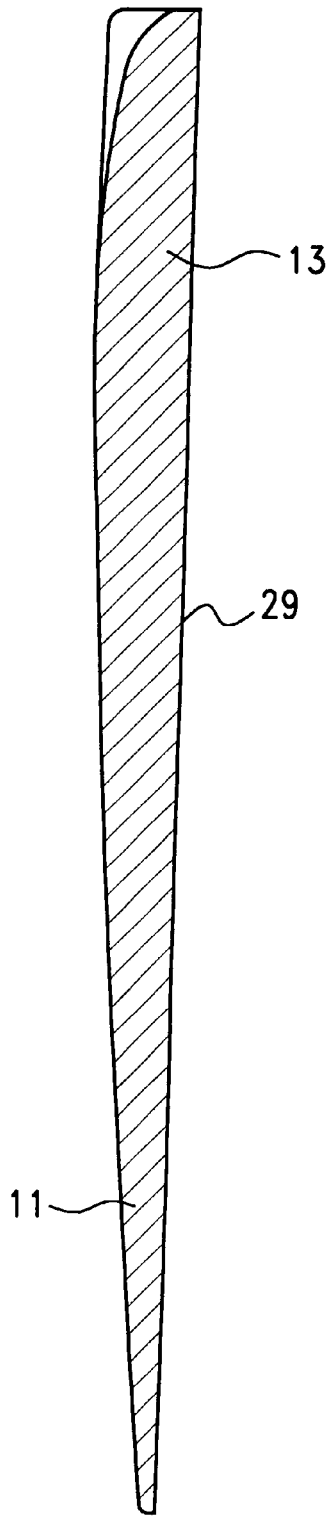
FIG. 3 is a cross-sectional view taken along the line 3—3 of FIG. 1.

FIG. 3 is a cross-sectional view taken along the line 3—3 of FIG. 1 showing the tapered thickness 13 of the fin body 11 which ranges from 1/8 inch to 7/16 inches. The bottom 29 of the fin body is flat.

Figure 4:
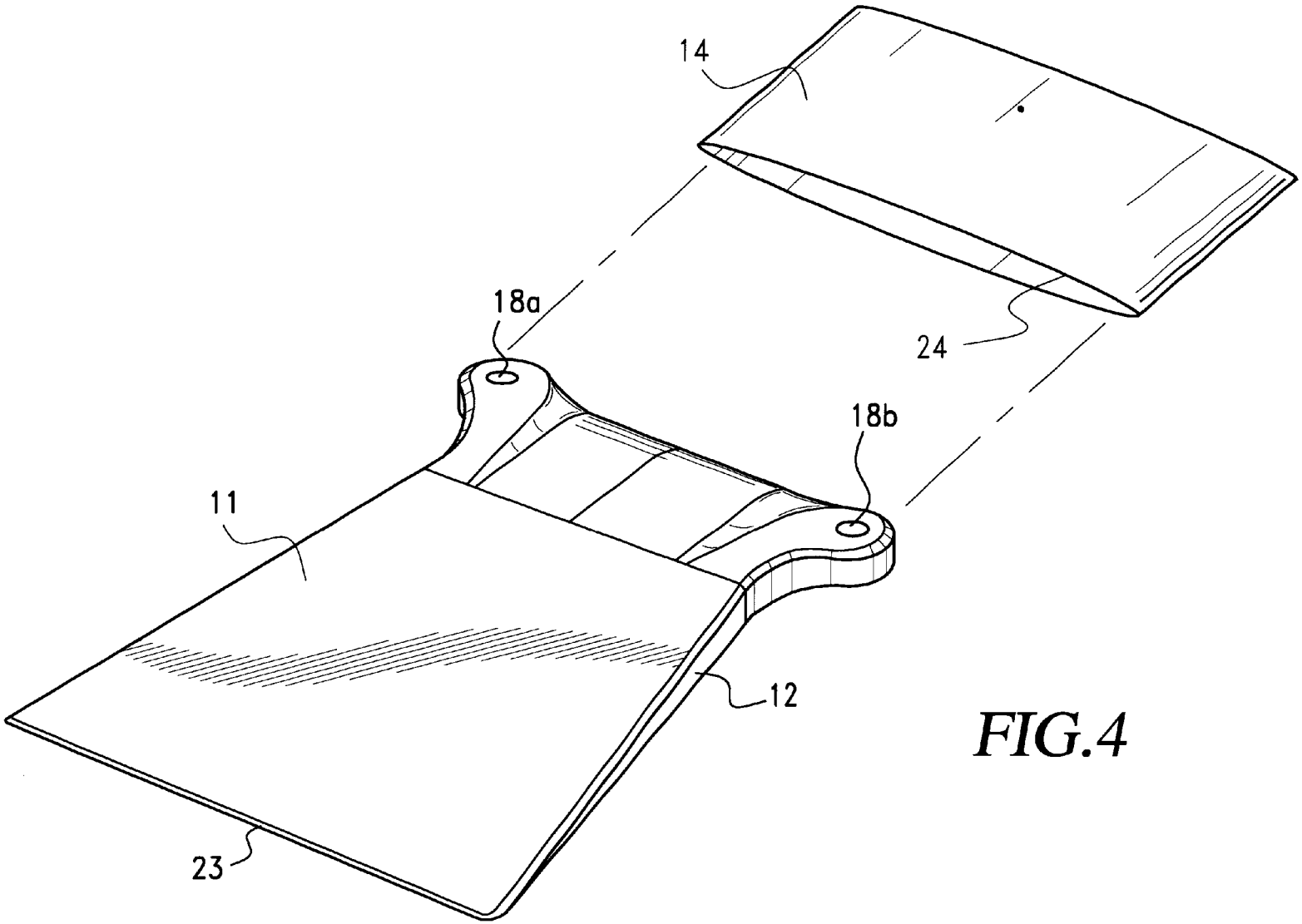
FIG. 4 is an exploded view of the fin and sleeve assembly.
Figure 5:
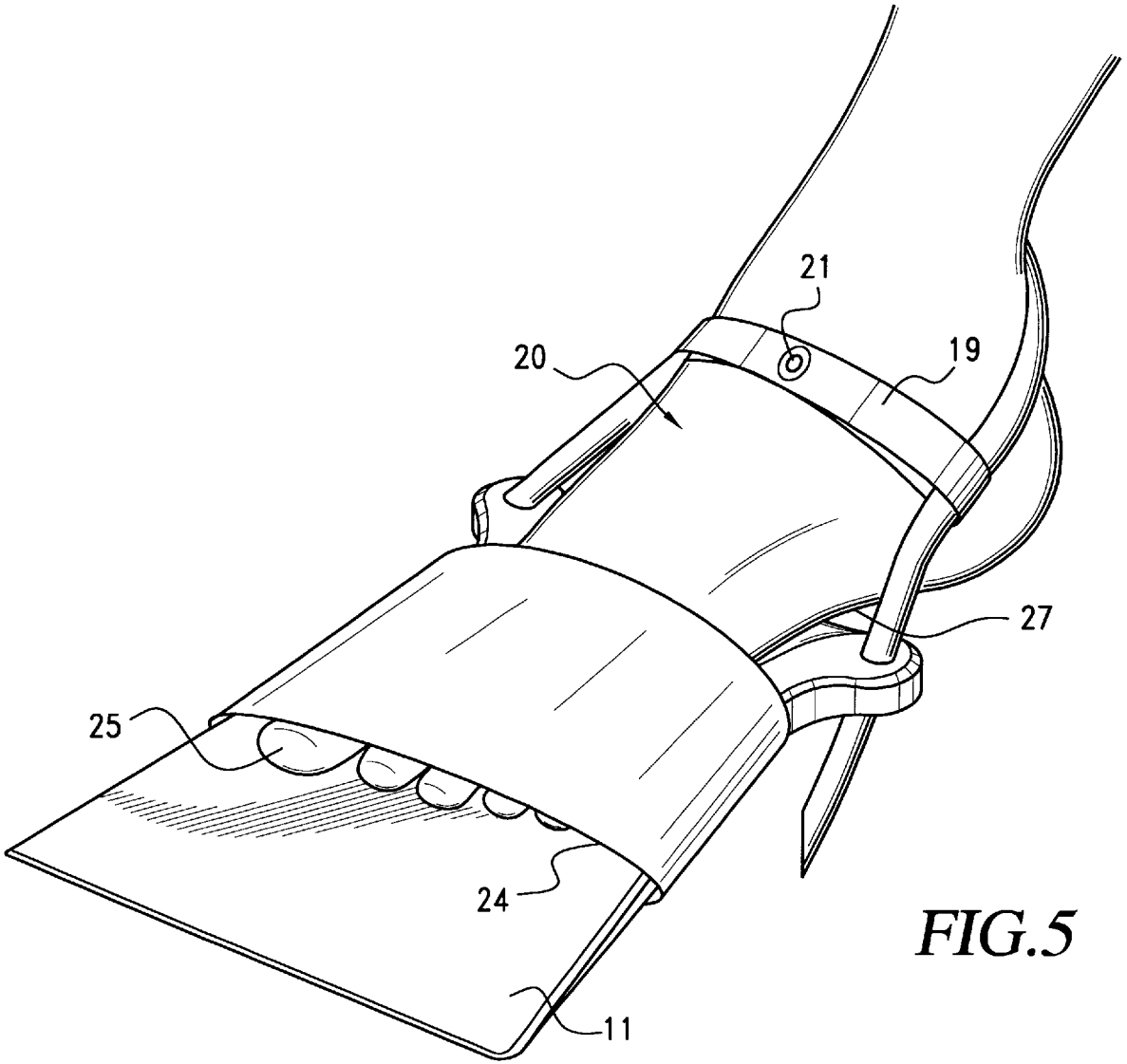
FIG. 5 is a perspective view of the invention assembled on the foot of a swimmer.

FIG. 4 depicts the fin body 11 and sleeve 19 prior to assembly while FIG. 5 depicts the swim fin 10 in an assembled condition on a swimmer's foot. This fin 10 is cheaper and more effective than prior art design.

While the invention has been explained by a detailed description of certain specific embodiments, it is understood that various modifications and substitutions can be made in any of them within the scope of the appended claims, which are intended also to include equivalents of such embodiments.

What is claimed is:

1. A swim fin for attachment to a swimmer's foot for the improvement of the fast flutter kick motions of speed swimming comprising:

a fin body having a tapered thickness and a first end portion and a second end sculling portion and an intermediate portion tapering outwardly from the first end portion to the second end portion;

a flexible sleeve having an aperture extending therethrough, said sleeve being removably mounted over the fin body to hold a swimmer's foot in position thereon; and mounting means for the foot comprising an elastic loop mounted to the first end portion of the fin body and including an elastic band having apertures with the loop extending therethrough; and, wherein the flexing action of the tapered fin body causes a reverse pressure against the sleeve to maintain a constant optimum pressure around the foot to self-adjust to different foot sizes; and the tapered thickness produces a faster flexing action at the second sculling end portion.

2. A swim fin for attachment to a swimmer's foot for the improvement of the fast flutter kick motions of speed swimming in accordance with claim 1 wherein:

the fin body comprises an upper portion and a flat lower portion, the upper portion comprising a sloped surface from the second end portion to the first end portion.

3. A swim fin for attachment to a swimmer's foot for the improvement of the fast flutter kick motions of speed swimming in accordance with claim 1 wherein:

the fin body comprises an injection molded rubber composite material.

4. A swim fin for attachment to a swimmer's foot for the improvement of the fast flutter kick motions of speed swimming in accordance with claim 3 wherein:

the first end portion of the fin body comprise a first enlarged edge portion and a second enlarged edge portion having loop apertures extending therethrough and an intermediate depressed portion to accommodate the swimmer's foot.

5. A swim fin for attachment to a swimmer's foot for the improvement of the fast flutter kick motions of speed swimming in accordance with claim 3 wherein:

the thickness of the fin body ranges from 1/16 inch at the second end portion to 7/16 inches at the first end portion.

6. A swim fin for attachment to a swimmer's foot for the improvement of the fast flutter kick motions of speed swimming in accordance with claim 3 wherein:

the hollow sleeve is mounted about the intermediate fin body, said body being tapered to provide a looseness which facilitates entry of the foot.

7. A swim fin for attachment to a swimmer's foot for the improvement of the fast flutter kick motions of speed swimming in accordance with claim 4 wherein:

the elastic loop comprises rubber tubing having a first end and a second end, each end portion being inserted through a loop aperture in the fin body.

* * * * *